US009309896B2

(12) United States Patent
Vannini et al.

(10) Patent No.: US 9,309,896 B2
(45) Date of Patent: Apr. 12, 2016

(54) COMPRESSOR UNIT AND A METHOD TO PROCESS A WORKING FLUID

(75) Inventors: Giuseppe Vannini, Florence (IT); Luciano Mei, Florence (IT); Massimo Pinzauti, Florence (IT); Franco Frosini, Florence (IT)

(73) Assignee: Nuovo Pignone, S.P.A., Florence (IT)

( * ) Notice: Subject to any disclaimer, the term of this patent is extended or adjusted under 35 U.S.C. 154(b) by 872 days.

(21) Appl. No.: 13/513,813

(22) PCT Filed: Nov. 22, 2010

(86) PCT No.: PCT/IB2010/003165

§ 371 (c)(1),
(2), (4) Date: Aug. 21, 2012

(87) PCT Pub. No.: WO2011/067665

PCT Pub. Date: Jun. 9, 2011

(65) Prior Publication Data

US 2012/0321438 A1 Dec. 20, 2012

(30) Foreign Application Priority Data

Dec. 4, 2009 (IT) ..... CO09A0059

(51) Int. Cl.

| | |
|---|---|
| ***F04D 13/08*** | (2006.01) |
| ***F04D 29/051*** | (2006.01) |
| ***F04D 25/06*** | (2006.01) |
| ***F04D 31/00*** | (2006.01) |

(52) U.S. Cl.

CPC ..... *F04D 29/051* (2013.01); *F04D 13/08* (2013.01); *F04D 25/0686* (2013.01); *F04D 31/00* (2013.01)

(58) Field of Classification Search

CPC ..... F04D 13/08; F04D 25/0686; F04D 29/05; F04D 29/051

USPC ..... 415/110–113, 168.1, 168.2

See application file for complete search history.

(56) References Cited

U.S. PATENT DOCUMENTS

| | | | | |
|---|---|---|---|---|
| 3,364,866 | A | 1/1968 | Tetsuya | |
| 4,170,435 | A * | 10/1979 | Swearingen | 415/1 |
| 4,338,781 | A * | 7/1982 | Belke et al. | 60/39.35 |
| 4,477,223 | A * | 10/1984 | Giroux | 415/168.2 |
| 7,703,534 | B2 | 4/2010 | Sheshtawy | |
| 2007/0196215 | A1 * | 8/2007 | Frosini et al. | 417/120 |

(Continued)

FOREIGN PATENT DOCUMENTS

| | | | | |
|---|---|---|---|---|
| DE | 714290 | C | 11/1941 | |
| DE | 102007019264 | A1 * | 11/2008 | F04D 29/70 |

(Continued)

OTHER PUBLICATIONS

Search Report and Written Opinion for corresponding International Patent Application No. PCT/IB2010/003165, dated Feb. 28, 2011.

Search Report and Written Opinion for corresponding Italian Patent Application No. CO20090059, dated Apr. 21, 2010.

*Primary Examiner* — Igor Kershteyn
*Assistant Examiner* — Woody A Lee, Jr.
(74) *Attorney, Agent, or Firm* — GE Global Patent Operation

(57) ABSTRACT

A compressor unit for processing a working fluid comprising a compressor inside a housing to compress the working fluid wherein a collection chamber is fluidly coupled with a working fluid inlet of said housing.

20 Claims, 2 Drawing Sheets

(56) References Cited

U.S. PATENT DOCUMENTS

| | | | | |
|---|---|---|---|---|
| 2007/0292283 | A1 | 12/2007 | Oklejas | |
| 2010/0135769 | A1 * | 6/2010 | Kleynhans et al. | 415/58.4 |

FOREIGN PATENT DOCUMENTS

| | | | |
|---|---|---|---|
| GB | 1331668 | A | 9/1973 |
| WO | 2007103248 | A2 | 9/2007 |

* cited by examiner

COMPRESSOR UNIT AND A METHOD TO PROCESS A WORKING FLUID

CROSS REFERENCE TO RELATED APPLICATIONS

This is a national stage application wider 35 U.S.C. §371 (e) of prior-filed, co-pending PCT patent application serial number PCT/IB10/003,165, filed on Nov. 22, 2010, which claims priority to Italian Patent Application Serial No. CO2009A000059, filed on Dec. 4, 2009, the entire contents of which are incorporated herein by reference.

BACKGROUND OF THE INVENTION

Embodiments of the present invention relate to a compressor unit and a method to process a working fluid.

An industrial plant to extract natural gas from a field present under the seabed is in general placed on a platform above the sea or on the seabed.

In particular, the plant on the seabed comprises a submersible compressor unit and other modules preassembled on the ground and then placed in seabed itself.

The submersible compressor unit comprises generally a centrifugal compressor pushing the extracted natural gas to the mainland and arranged in a housing with an electric motor; this unit could be fluidly connected with an external separator machine placed between the well and the inlet of the unit. This type of compressor unit could be a machine with vertical configuration having a vertical shaft on which is arranged the rotor of the electric motor and also the centrifugal impellers of the compressor, the shaft is supported by a plurality of mechanical bearings and by a thrust bearing, preferably of a magnetic type. The main benefits of the vertical configuration are that the drainage is due to gravity and the footprint is minimized.

These two modules (the compressor unit and the separator machine) are usually provided with respective inlet and outlet openings that are closed with valves during the immersion phase on the seabed; during the installation phase, these two openings are fluidly coupled using a pipe and then the two valves are opened. The best practices include that the valve on the side of the separator machine is opened first; then the valve on the side of the unit is timely opened. In this way the water inside the pipe could be discharged into the separator; the pipe descends from the unit to the separator to facilitate the discharging.

A drawback of this type of machine lies in the fact that the valve of the unit could be opened before the valve of the separator by the operators, provoking the sea water discharge accidentally inside the compressor unit and damaging, the mechanical component of the unit itself.

The patent application WO-2007/103,248 describes a fluid processing machine to process multiphase fluid streams including gas and liquid. A housing has an interior chamber, an inlet fluidly connected with the interior chamber and with a stream source, and first and second outlets. A separator disposed within the housing chamber is fluidly coupled with the inlet such that the stream flows thereto and separates the stream into gaseous and liquid portions. A compressor disposed within the chamber receives and compresses the gaseous portions from the separator for discharge through the housing first outlet, the compressor having an outer surface spaced from the housing inner surface to define a flow passage. A pump provided within the chamber has an inlet fluidly coupled with the separator through the passage, is spaced vertically from the separator so that liquid flows by gravity from the separator to the pump, and pressurizes the liquid for discharge through the housing second outlet.

A disadvantage of this type of machine is that it requires a separator inside the compressor unit, increasing the mechanical complexity and the cost.

Another disadvantage is that the lower mechanical bearing is placed on an inferior baseplate of the housing, and so it is necessary to provide a sealing case to avoid the contact with water or waste. In particular, this case has to be a high sealing case if the bearing is of the magnetic type, increasing the installation and design cost and at the same time decreasing the reliability, that is particularly significant and important for the applications that require a non-stop working for a lot of years, as for example the submerged one.

Moreover, the shaft has to be so long as to place the aforesaid bearing on The baseplate increasing significantly the design cost.

A further disadvantage is that the length of the shaft is related to the vertical length of the chamber, that could vary only if the length of the shaft varies at the same time, increasing the cost and the difficulties for the design.

To date, notwithstanding the developments in technology, this poses a problem and the need exists to produce simpler and cheaper machines to extract natural gas from a field, present under the seabed, improving The installation phase and at the same time the working phase thereof.

BRIEF DESCRIPTION OF THE INVENTION

According to an embodiment a compressor unit for processing a working fluid is provided. The compressor unit comprises a compressor inside a housing to compress the working fluid, and a collection chamber fluidly coupled with a working fluid inlet of the housing.

According to another embodiment a method to process a working fluid is provided. The method comprises providing a compression unit with a housing, the compressor unit comprising a compressor inside the housing and a collection chamber fluidly coupled with a working fluid inlet of the housing, associating the compression unit to external auxiliaries on a working place, and operating the compression unit to compress the working fluid.

BRIEF DESCRIPTION OF THE DRAWINGS

This invention will be more apparent by following the description and accompanying drawing, which shows a non-limiting practical embodiment of said invention. More specifically, in the drawing, where the same numbers indicate the same or corresponding parts.

DETAILED DESCRIPTION OF THE EXEMPLARY EMBODIMENTS OF THE INVENTION

Figure 1:
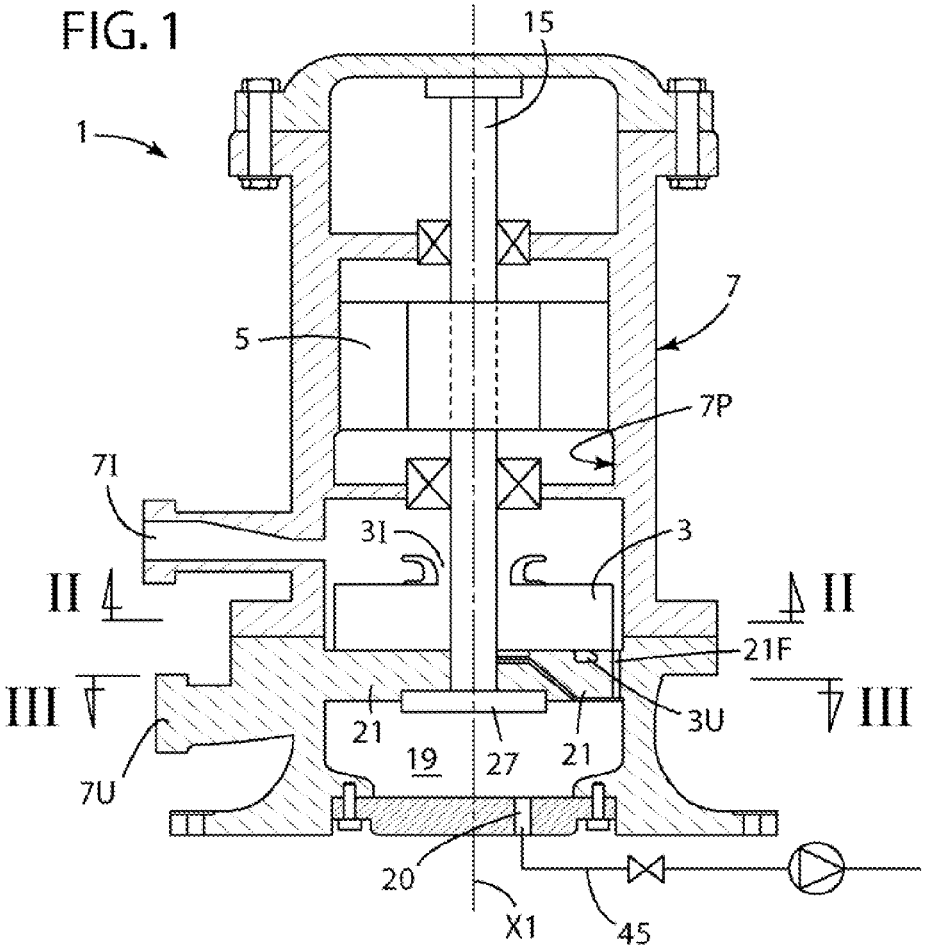
FIG. 1 shows a vertical schematic section of a machine according to an embodiment of the invention.
Figure 2:
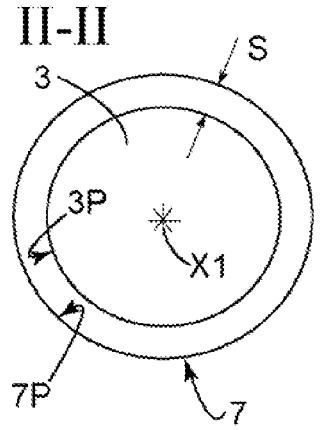
FIG. 2 shows a schematic view of the section of FIG. 1.
Figure 3:
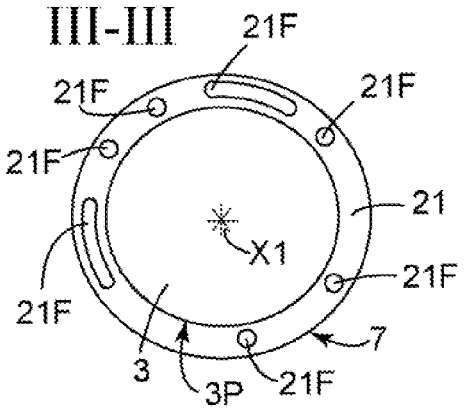
FIG. 3 shows a schematic view of the section III-II of FIG. 1.

In the drawings, in which the same numbers correspond to the same parts in all the various Figures, a machine according to the embodiments of the present invention is indicated generically with the number 1. This machine 1 comprises a compressor 3 and a motor 5, see FIG. 1, located in a pressurized sealed common housing 7.

Figure 4:
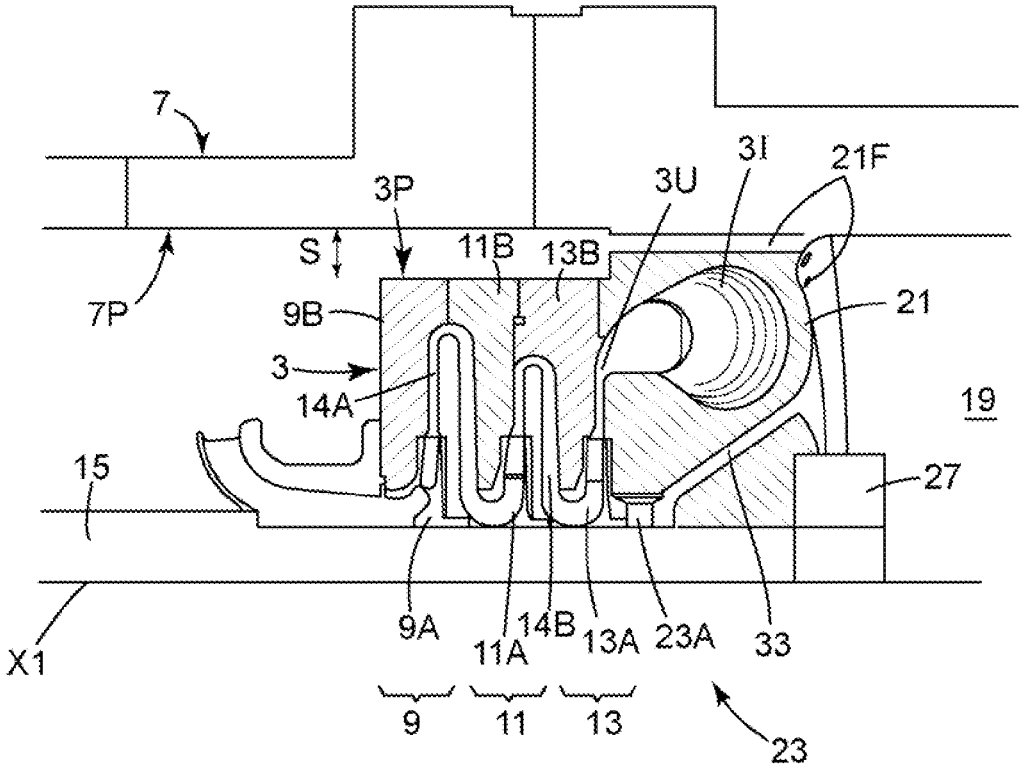
FIG. 4 shows a vertical section of a detail of the FIG. 1.

According to this exemplary embodiment, the compressor 3 is a multistage centrifugal compressor comprising a plurality of compression stages 9, 11, 13, each of them having a centrifugal impeller 9A, 11A and respectively 13A rotating inside a stator diaphragm 9B, 11B and respectively 13B and coupled on a shaft 15 along an axis X1; between each stator diaphragms 9B, 11B, 13B there are stator channels 14A, 14B—see FIG. 4—for the fluid to be compressed (each stator channels formed by a diffuser and a return channel, not indicated in the drawings for simplicity and well known by those skilled in the art).

Although a multistage centrifugal compressor 3 is described above, the compressor 3 may alternatively be constructed as a single stage centrifugal compressor or any other type of compressor capable of compressing a gas, such as for example a radial compressor, a reciprocating compressor, a rotary screw compressor or others.

In the embodiment showed in FIG. 1, the unit 1 has a vertical configuration, so as the shaft 15 (and the axis X1) is placed substantially in vertical position (during the working of the unit 1) comprising a superior end and an inferior end 15S and respectively 15I; however, it is not to exclude that the unit could have a different configuration according to specific embodiment or needs of use, as for example a substantially horizontal configuration with the shaft (and the axis) placed substantially in a horizontal position.

Advantageously, the motor 5 is placed inside the housing 7 and it is mechanically coupled to the compressor 3 by the shaft 15, in order to obtain a machine particularly compact and without outward dynamic seals. However, it is not to exclude that the motor may be placed outside the housing in accordance with particular embodiments of the invention.

In the configuration described here, the motor 5 is arranged vertically above the compressor 3, to minimize the chance of liquid intrusion into the motor 5. However, the motor 5 may otherwise be mounted, such as for example to the inferior end 15I of the housing 7 or providing a first compressor above the motor and another compressor under the motor; but, in these cases, further components are required (as for example a mechanical seal to seal the motor 5 from the rest of the machine) and so the mechanical complexity and the cost of the machine will increase. Also, the motor 5 may be an electric motor configured to rotate the shaft 15 about its axis X1; it may alternatively be a hydraulic motor, a steam or gas turbine or any other appropriate motor or engine in general.

Further, the shaft 15 may be directly driven by the motor 5, as described above, but may alternatively be driven through a belt drive, gear train or other appropriate transmission means (not shown for simplicity).

The housing 7 comprises also a fluid inlet 7I fluidly connected with a fluid inlet 31 of the compressor 3 and a fluid outlet 7U fluidly connected with a fluid outlet 3U of the compressor 3, it has to be noted that, according to the vertical configuration, the fluid inlet 7I and the fluid outlet 7U of the housing 7 are placed one above the other.

A collection chamber 19 may be provided inside the housing 7 under the compressor 3 and is fluidly connected with the fluid inlet 7I of the housing 7 itself. It has to be noted than if the machine 1 is in horizontal configuration, the collection chamber 19 may be placed in another position so that the fluid can flow into it.

According to an embodiment, the collection chamber 19 is configured to collect completely the liquid possibly entered inside said unit 1 during a submerged installation phase thereof, in order to avoid substantially the passage of said liquid inside the compressor 3.

Therefore, it is possible to improve the installation (and uninstall) phase, in particular it is possible to avoid substantially that the liquid enters inside the compressor of the unit due to wrong operations. In particular, the seawater (when the compressor unit is placed under the sea) is particularly dangerous for the mechanical components of the unit itself.

According to another embodiment, the collection chamber 19 is fluidly coupled with a balance system 23, see also description below referred to FIG. 4, of the compressor unit 1 so that this chamber 19 may be filled with part of the working fluid to balance at least in part the axial thrust during the working phase; the other part of the working fluid enter inside the compressor 3 to be compressed.

Therefore, it is possible to realize a balancing system inside the unit avoiding mechanical flanges and external pipeline, reducing the risk for leakages, which is very important in subsea applications.

It has to be noted that an embodiment of the present invention comprises the aforesaid two embodiments implemented together on the same compression unit; however, it is not to be excluded that these two embodiments could be implemented separately according to particular needs of construction or use.

According to an embodiment, this chamber 19 has a volume at least equal to the upstream volume that could be filled by the liquid during the installation phase, see description below.

However, it is possible to size the volume of the collection chamber according to specific requirements, without any mechanical constraint, in particular no need to vary the rotor length.

A normally-closed liquid outlet 20 may be provided on the bottom of the chamber 19; this liquid outlet 20 may be opened to discharge said liquid portion during the installation phase, see description below.

Alternatively, it has to be noted that the collection chamber 19 may be located outside of the housing 7, but in this case the mechanical complexity and the cost of the machine will increase.

In the configuration described here, the housing 7 includes an inner surface 7P—see FIG. 1, 2, 3—and the compressor 3 has an outer surface 3P spaced S from the housing inner surface 7P; the compressor 3 may be supported inside the housing 7 by a radial support 21 extending circumferential about the axis X1 from the inner surface 7P, this radial support 21 having a plurality of holes 21F. These holes 21F can have any shape or form, especially circular holes. In this way, the aforesaid flow passages from the inlet 7I to the chamber 19 is created.

However, this flow passage may be created in another way according to specific needs or requirements, as for example by means of channels extending externally in respect of the housing 7.

FIG. 4 shows an embodiment of the present invention in which the balance system 23 of the compressor 3 is fluidly coupled with the chamber 19 so that, when the chamber 19 is filled with part of the working fluid entering in the inlet 7I during the working phase, it is possible to balance at least in part the axial thrust of the compressor 3 by this part of the working fluid; the other part of the fluid may enter inside the compressor.

This balance system 23 may comprise substantially a balancing piston 23A coupled with the shaft 15 in proximity of the last impeller 13A of the compressor 3 so as it presents the maximum pressure of the working fluid at one side and the inlet pressure of the working fluid at the opposite side.

FIG. 4 also shows the balancing piston 23A placed between said last impeller 13A and a bearing system 27; the bearing system 27 is disposed at the inferior end 15I of the shaft 15 in a position able to avoid the contact with the liquid, when present. In other words, the bearing system 27 may be placed above the maximum level of the liquid inside the collection chamber 19.

The bearing system 27 could comprise a journal bearing and/or a thrust bearing. The bearing system may be realized by a magnetic bearing with a landing hearing associated thereof.

Moreover, it is not to be excluded that the piston 23A may be placed in a different position on the shaft 15 or may consist of different mechanical components, according to particular configurations or required needs.

In this configuration, the radial support 21 may comprise at least in part an inner flow path or channel 33 to fluidly connect the chamber 19 to the balance system 23; furthermore, the radial support 21 may comprise at least in part an outlet volute 31 of the compressor 3 fluidly connect to the outlet 7U.

The support 21 could be made in a single piece with the housing 7 (as schematically showed in FIG. 4) or made apart and then associated inside with the housing itself.

Figure 5:
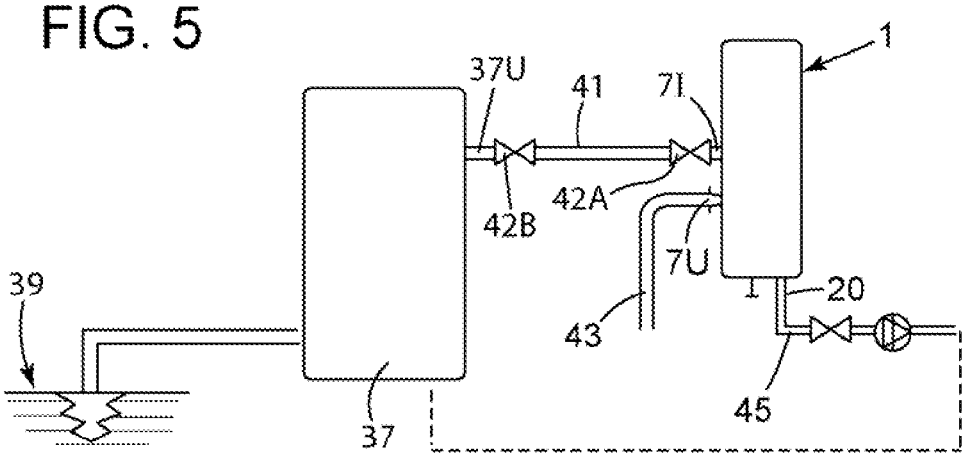
FIG. 5 shows a compression system comprising the machine of FIG. 1 according a particular embodiment of the invention.

FIG. 5 schematically shows an embodiment of the invention in which an external separator 37 is fluidly connected with the aforesaid unit 1 by means of a pipe 41; this separator 37 is able to separate at least in part the liquid portion from the gaseous portion of the working fluid coming from a gas well 39, or other fluid sources.

In particular, the pipe 41 is connected on the one side to the outlet 3715 of the separator 37 and on the other side to the inlet 7I of the unit 1.

A first valve 42A is associated with the inlet 7I, a second valve 42B is associated with the outlet 37U.

Moreover, in this Figure is shown schematically a pressure piping 43 to fluidly connect the outlet 7U of the unit 1 to a production pipeline (not shown for simplicity) and a draining piping 45 to fluidly connect said liquid outlet 20 to the separator 37 in order to discharge the liquid portion of the working fluid during the installation phase. During the installation phase, the compression unit 1 and the separator 37 ma be installed on the seabed and then fluidly connecting them each other by the pipe 41 and with the other machines and systems by the piping 43, 45.

In particular, the connection phase between the unit 1 and the separator 43 may be realized by mechanically coupling the pipe 41 to the inlet 71 and to the outlet 37U and then opening the valves 42A and 42B. In this way, the water that fills the pipe 41 may flow into the separator 43 (the pipe 41 could be inclined to facilitate the flowing of the water into the separator 43), but it is not to exclude that at least part of that water could flow inside the unit I.

In the case that at least part of the water flows inside the unit 1, then the water flows along the flow passages realized, in this particular embodiment by said space S and holes 21F and then the water flows inside the collection chamber 19; the water collected inside the chamber 19 may be discharged by opening the normally-closed liquid outlet 20.

According to an embodiment, said working place is on the seabed and the phase (b) comprises a sub-phase in which the liquid possibly entered into the unit is drained inside the collection chamber 19 during the installation phase of the unit itself in order to avoid substantially the passage of said liquid inside the compressor 3.

According to another embodiment, during the operating phase c) of the unit, it is provided a sub-phase for filling the collection chamber 19 with part of the working fluid in order to balance at least in part the axial thrust of the compressor 3 by means of fluid connections to the balance system 21 the other part of the gaseous portion entered inside the compressor 3 to be worked.

During the working phase, the working fluid is fed from the separator 37 to the compressor unit 1 where most of the fluid flows inside the compressor 3 and, at the same time, a small amount of said fluid may flow inside said flow passages 5 and 21F to fill the chamber 19.

In the compressor 3 the working fluid is compressed and flows from the outlet 7U at the outlet pressure; in the chamber 19 the working fluid is collected to feed the balancing system 23, as described upon.

It should be noted that FIG. 5 merely represents a possible embodiment of the invention, which may vary in forms and arrangements according to specific industrial plants or systems. In particular, the compressor unit 1 according to a particular embodiment of the invention could be used to work acid gas for terrestrial applications, in which is required sealing compressors to avoid substantially that the acid gas could escape from the unit itself.

The disclosed exemplary embodiments provide a compression unit and a method to process a working fluid for easily compress said fluid. The mechanical complexity of these exemplary embodiments is relative low, which is particularly significant and important for submerged applications, that require a non-stop working for a lot of years.

Said embodiments are also able to be installed under the sea and to work for a lot of years (in general for a lot of years) without stopping and maintenance.

Moreover, it is possible to use these embodiments in other industrial applications maintaining substantially the above advantages, as for example to compress a sour and acid gas or other.

It should be understood that this description is riot intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using an devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. A compressor unit for processing a working fluid, the compressor unit comprising:

a compressor inside a housing to compress the working fluid; and a collection chamber fluidly coupled with a working fluid inlet of the housing and with a balance system of the compressor, wherein the collection chamber is filled with part of the working fluid to balance at least in part an axial thrust of the compressor during a working phase, and wherein other part of the working fluid enters the compressor to be worked.

2. The compressor unit according to claim 1, wherein the collection chamber is configured to drain liquid that enters the compressor unit during a submerged installation phase to avoid passage of the liquid to inside the compressor.

3. The compressor unit according to claim 2, wherein the collection chamber comprises a normally closed discharge opening that could be opened to discharge the liquid.

4. The compressor unit according to claim 2, wherein the compressor unit is of a vertical type comprising a shaft rotatable about a central axis extending substantially in a vertical direction, the shaft comprising an inferior end having a bearing system placed between the compressor and the collection chamber in a position such that the bearing system does not contact the liquid that enters the compressor unit.

5. The compressor unit according to claim 4, wherein the balance system of the compressor further comprises a balancing piston coupled with the shaft.

6. The compressor unit according to claim 4, wherein the compressor is supported inside the housing by a radial support extending circumferentially about the central axis.

7. The compressor unit according to claim 6, wherein the radial support has a plurality of holes for creating a plurality of flow passages from the working fluid inlet of the housing to the collection chamber.

8. The compressor unit according to claim 7, wherein the radial support further comprises an inner channel to fluidly connect the collection chamber to the balance system of the compressor.

9. The compressor unit according to claim 1, wherein a separator, external to the compression unit, is fluidly connected with the compression unit by a pipe.

10. The compressor unit according to claim 9, wherein the pipe is connected to an outlet of the separator at one end and to the working fluid inlet of the housing at other end.

11. The compressor unit according to claim 1, further comprising a motor inside the housing, the motor being mechanically coupled to the compressor.

12. A method to process a working fluid, the method comprising:

providing a compression unit with a housing, the compression unit comprising a compressor inside the housing and a collection chamber fluidly coupled with a working fluid inlet of the housing and with a balance system of the compressor;

associating the compression unit to external auxiliaries on a working place;

operating the compression unit to compress the working fluid, wherein operating the compression unit comprises filling the collection chamber with part of the working fluid to balance at least in part an axial thrust of the compressor, wherein other part of the working fluid enters the compressor to be worked.

13. The method of claim 12, wherein the working place is on a seabed and wherein associating the compression unit to external auxiliaries comprises draining liquid that enters the compression unit into the collection chamber to avoid passage of the liquid to inside the compressor during a submerged installation phase.

14. The method of claim 13, wherein the collection chamber comprises a normally closed discharge opening that could be opened to discharge the liquid.

15. The method of claim 13, wherein the compressor unit is of a vertical type comprising a shaft rotatable about a central axis extending substantially in a vertical direction, the shaft comprising an inferior end having a bearing system placed between the compressor and the collection chamber in a position such that the bearing system does not contact the liquid that enters the compressor unit.

16. The method of claim 15, further comprising:

supporting the compressor inside the housing by a radial support extending circumferentially about the central axis.

17. The method of claim 16, wherein the radial support has a plurality of holes for creating a plurality of flow passages from the working fluid inlet of the housing to the collection chamber and wherein the radial support further comprises an inner channel to fluidly connect the collection chamber to the balance system of the compressor.

18. The method of claim 12, further comprising:

fluidly connecting a separator, external to the compression unit, with the compression unit by a pipe.

19. The method of claim 18, wherein the pipe is connected to an outlet of the separator at one end and to the working fluid inlet of the housing at other end.

20. A compressor unit for processing a working fluid, the compressor unit comprising:

a compressor inside a housing to compress the working fluid; and a collection chamber fluidly coupled with a working fluid inlet of the housing and with a balance system of the compressor, wherein the collection chamber is configured to completely drain liquid that enters the compressor unit during a submerged installation phase to avoid passage of the liquid to inside the compressor, and wherein the collection chamber is filled with part of the working fluid to balance at least in part an axial thrust of the compressor during a working phase and wherein other part of the working fluid enters the compressor to be worked.

* * * * *